US010143320B1

(12) United States Patent
Batts

(10) Patent No.: US 10,143,320 B1
(45) Date of Patent: Dec. 4, 2018

(54) PACKAGE LOCKING SYSTEM

(71) Applicant: John R. Batts, Charlotte, NC (US)

(72) Inventor: John R. Batts, Charlotte, NC (US)

( * ) Notice: Subject to any disclaimer, the term of this patent is extended or adjusted under 35 U.S.C. 154(b) by 7 days.

(21) Appl. No.: 15/895,078

(22) Filed: Feb. 13, 2018

(51) Int. Cl.
*A47G 29/124* (2006.01)
*A47G 29/20* (2006.01)

(52) U.S. Cl.
CPC ..... *A47G 29/124* (2013.01); *A47G 29/20* (2013.01)

(58) Field of Classification Search
CPC ..... A47G 29/122; A47G 29/1223; A47G 29/124; A47G 29/16; A47G 29/20; A47G 29/30; A47G 2029/144; A47G 2029/148; B65D 33/28
USPC ..... 232/30–32, 19, 45, 29, 1 E; 220/476; 70/64, 65; 383/61.4
See application file for complete search history.

(56) References Cited

U.S. PATENT DOCUMENTS 209,233 A * 10/1878 Cox ..... F16G 11/06 24/135 R
651,256 A * 6/1900 May ..... B65D 33/14 383/71
665,942 A * 1/1901 Tabler ..... B65D 33/28 383/2
1,351,388 A * 8/1920 Kabaci ..... B65D 63/14 383/25
1,602,837 A * 10/1926 Rhodes ..... A47G 29/122 232/19
2,578,691 A * 12/1951 Gieseler ..... A47G 29/12 232/17
2,578,693 A * 12/1951 Gieseler ..... A47G 29/12 232/19
2,604,260 A * 7/1952 Brown ..... A47G 29/12 232/19
3,602,423 A * 8/1971 Corkery ..... A47G 29/12 232/17
3,749,302 A * 7/1973 White ..... A47G 29/12 232/17
4,785,960 A * 11/1988 Belisle ..... B65D 33/28 220/23.83
5,595,073 A * 1/1997 Sullivan ..... E05B 17/002 70/159
5,624,071 A * 4/1997 Sosan ..... A47G 29/20 232/1 B
5,845,843 A * 12/1998 Kuller ..... A47G 29/12 232/38
8,358,199 B2 1/2013 Nesling
(Continued)

FOREIGN PATENT DOCUMENTS

WO 2015160632 10/2015

*Primary Examiner* — William L Miller
(74) *Attorney, Agent, or Firm* — Kyle A. Fletcher, Esq.

(57) ABSTRACT

The package locking system comprises a box, a bag, a cable, and a lock. The box may comprise four side walls, a bottom, and a hinged lid and may mount to a building. Mail may be left inside the box for delivery. The bag, the cable, and the lock may be located inside of the box and may be used to accept delivery of one or more packages. The cable may pass through a casing around a package aperture on the bag. The ends of the cable may pass through the lock and may be coupled to the box. A package may be placed into the bag and the lock may be slid towards the bag to gather the material of the bag around the package aperture. An internal mechanism of the lock may prevent the lock from sliding away from the bag unless released by a key.

13 Claims, 9 Drawing Sheets

(56) References Cited

U.S. PATENT DOCUMENTS

| | | | | |
|---|---|---|---|---|
| 9,364,112 | B2 * | 6/2016 | Sundaresan | A47G 29/124 |
| 9,596,952 | B2 * | 3/2017 | Mencel | A47G 29/20 |
| 9,630,757 | B1 | 4/2017 | Capous | |
| 9,926,108 | B2 * | 3/2018 | Wiley | B65D 33/00 |
| 2007/0277352 | A1 * | 12/2007 | Maron | A45C 3/06 24/298 |
| 2010/0085148 | A1 * | 4/2010 | Nesling | A47G 29/141 340/5.73 |
| 2012/0269461 | A1 | 10/2012 | Proctor | |
| 2013/0077896 | A1 | 3/2013 | Wiley | |
| 2016/0051073 | A1 * | 2/2016 | Heinz | A47G 29/141 232/39 |

* cited by examiner

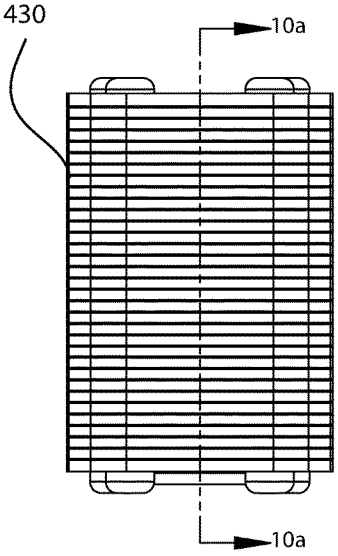
FIG. 10
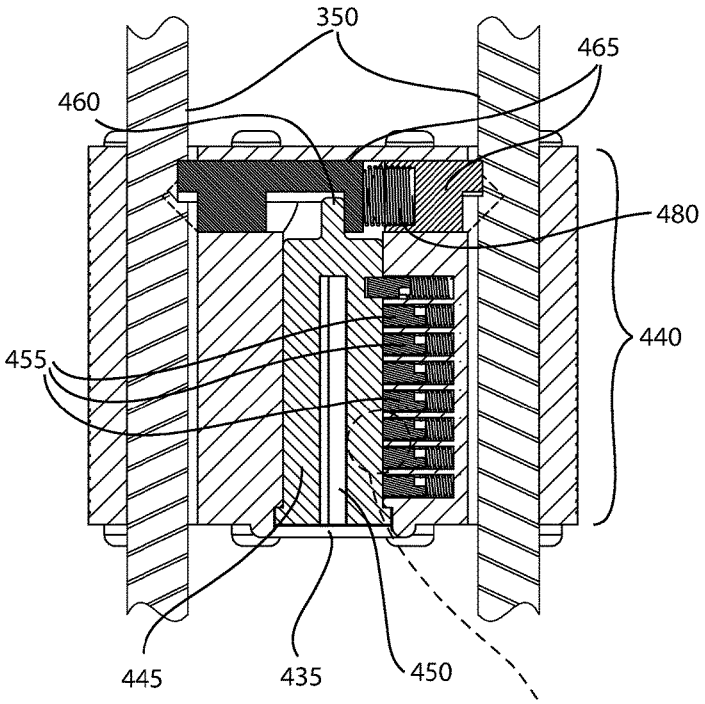
FIG. 10a
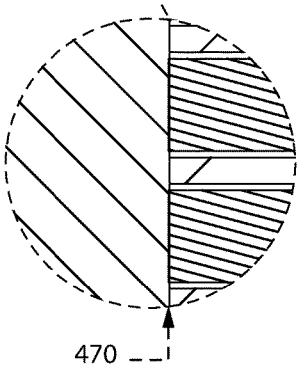

PACKAGE LOCKING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of package delivery systems and mailboxes, more specifically, a package locking system.

SUMMARY OF INVENTION

The package locking system comprises a box, a bag, a cable, and a lock. The box may comprise four side walls, a bottom, and a hinged lid and may mount to a building. Mail may be left inside the box for delivery. The bag, the cable, and the lock may be located inside of the box and may be used to accept delivery of one or more packages. The cable may pass through a casing around a package aperture on the bag. The ends of the cable may pass through the lock and may be coupled to the box. A package may be placed into the bag and the lock may be slid towards the bag to gather the material of the bag around the package aperture. An internal mechanism of the lock may prevent the lock from sliding away from the bag unless released by a key.

An object of the invention is to prevent the theft of one or more delivered packages.

Another object of the invention is to retain the one or more packages inside of a bag that is cable to a deliver box and locked closed.

A further object of the invention is to accept deliver of the one or more packages without requiring use of a key to activate the locking system.

Yet another object of the invention is to require the use of a key to access the one or more packages.

These together with additional objects, features and advantages of the package locking system will be readily apparent to those of ordinary skill in the art upon reading the following detailed description of the presently preferred, but nonetheless illustrative, embodiments when taken in conjunction with the accompanying drawings.

In this respect, before explaining the current embodiments of the package locking system in detail, it is to be understood that the package locking system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the package locking system.

It is therefore important that the claims be regarded as including such equivalent construction insofar as they do not depart from the spirit and scope of the package locking system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 10 is a side view of an embodiment of the disclosure illustrating the lock.

FIG. 10*a* is a cross-sectional view of an embodiment of the disclosure across 10*a*-10*a* as shown in FIG. 10.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
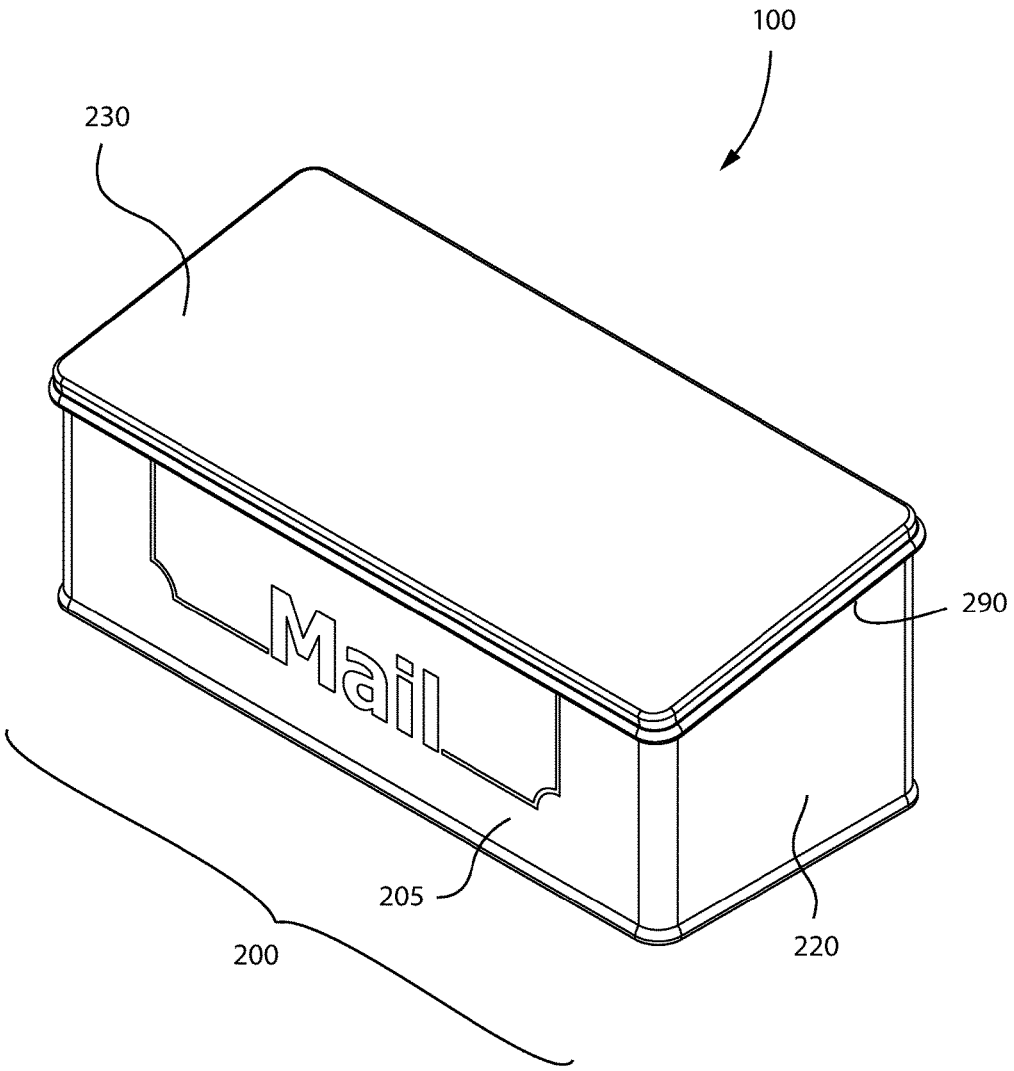
FIG. 1 is a perspective view of an embodiment of the disclosure.
Figure 2:
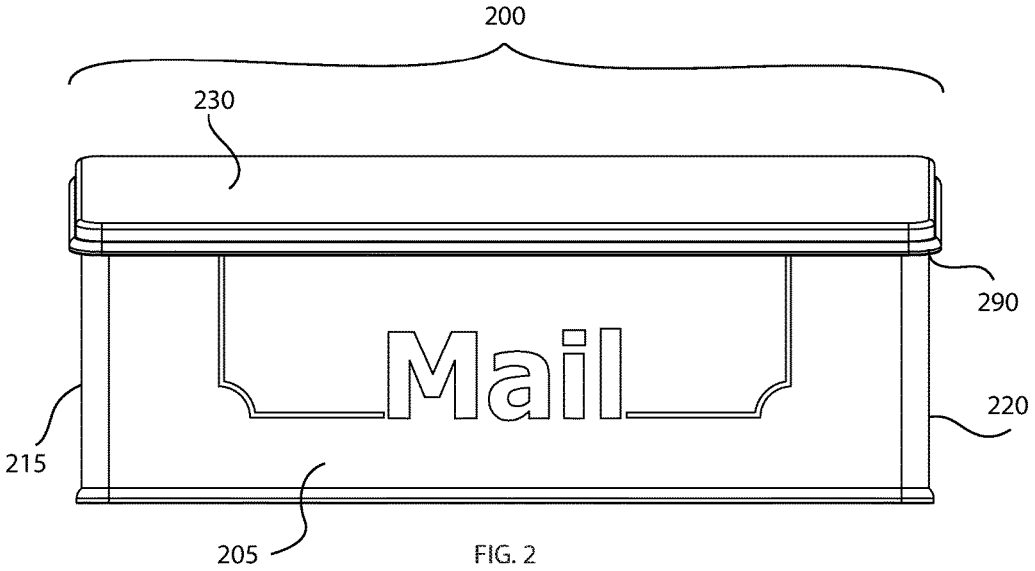
FIG. 2 is a front view of an embodiment of the disclosure.
Figure 3:
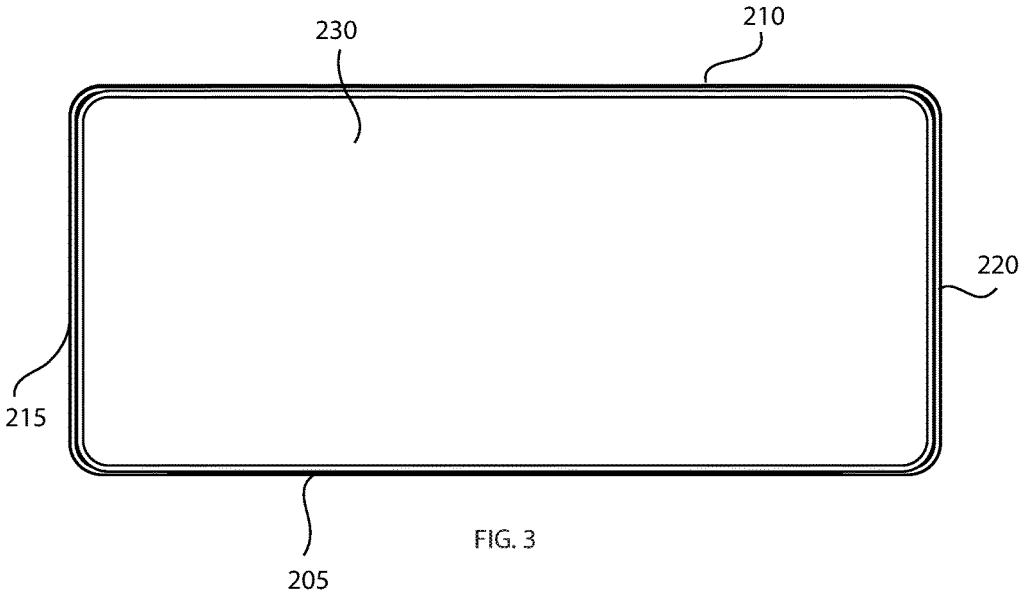
FIG. 3 is a top view of an embodiment of the disclosure.
Figure 4:
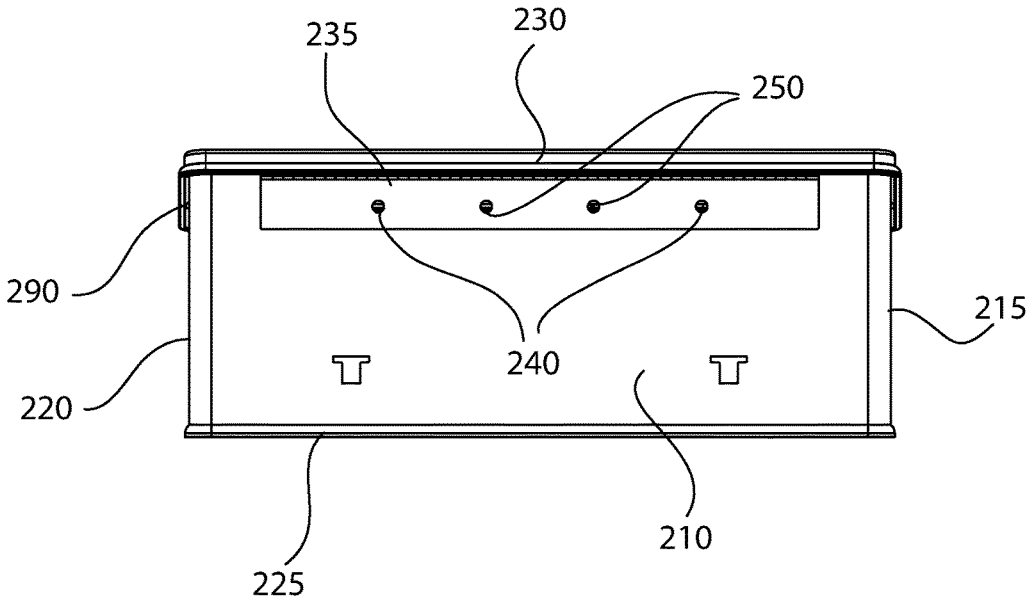
FIG. 4 is a rear view of an embodiment of the disclosure.
Figure 5:
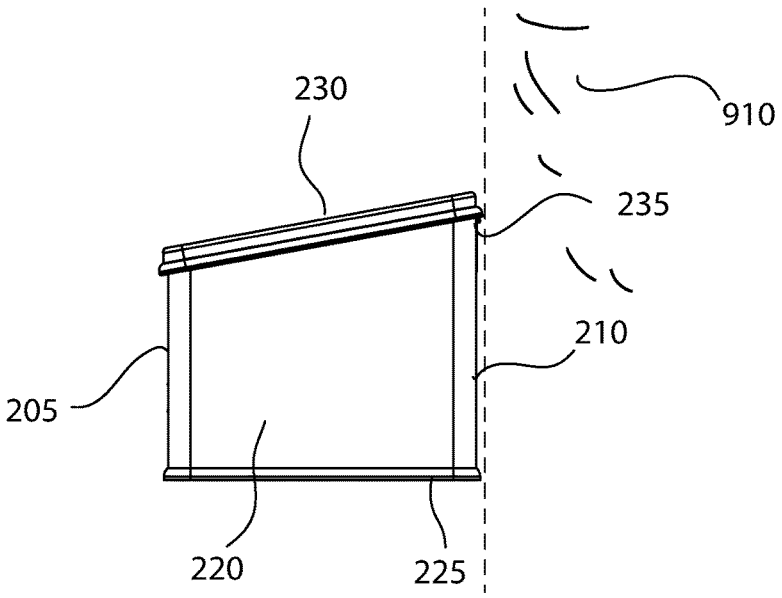
FIG. 5 is a side view of an embodiment of the disclosure.
Figure 6:
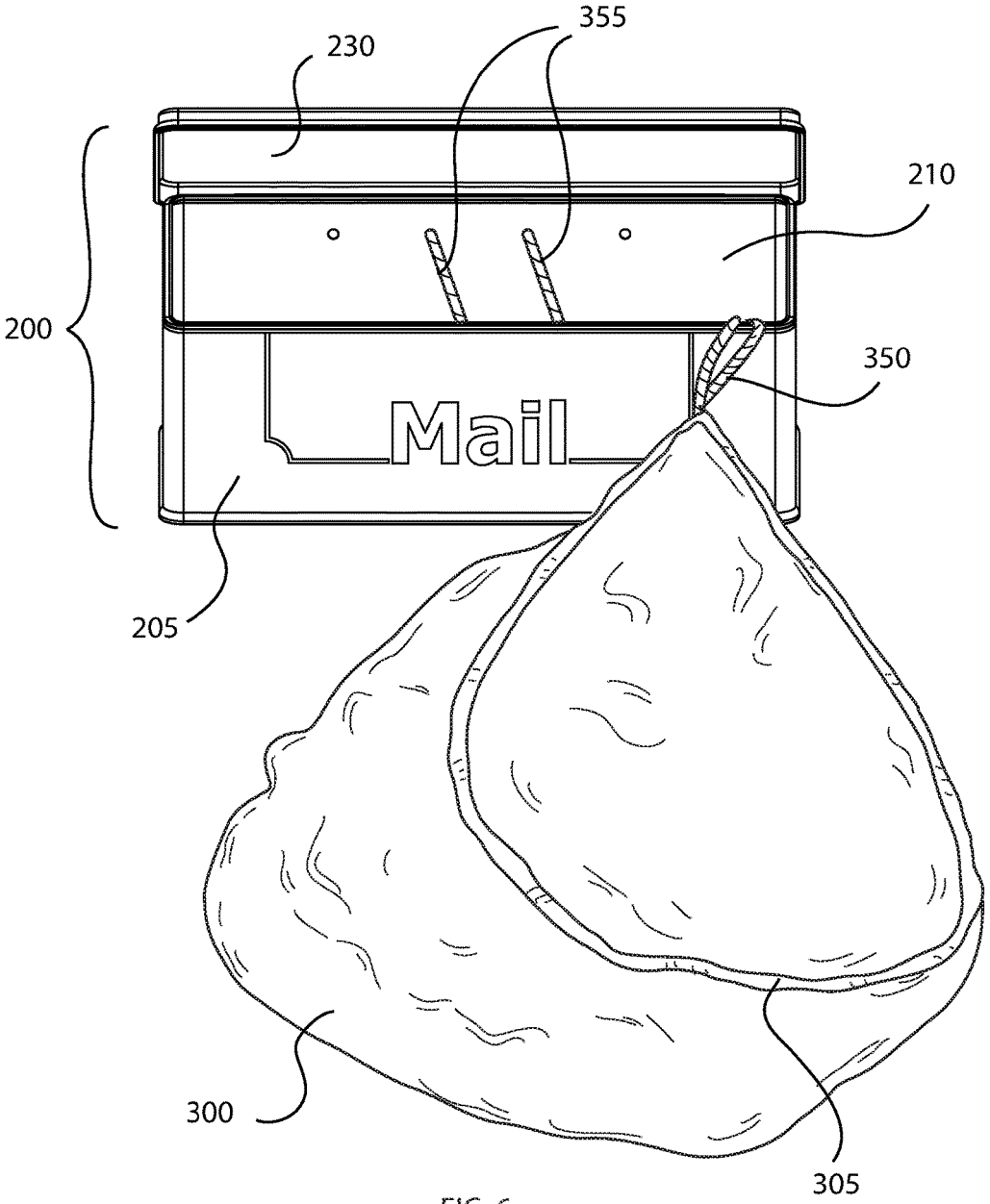
FIG. 6 is an in-use view of an embodiment of the disclosure illustrating the bag removed from the box and prepared to accept a package.
Figure 7:
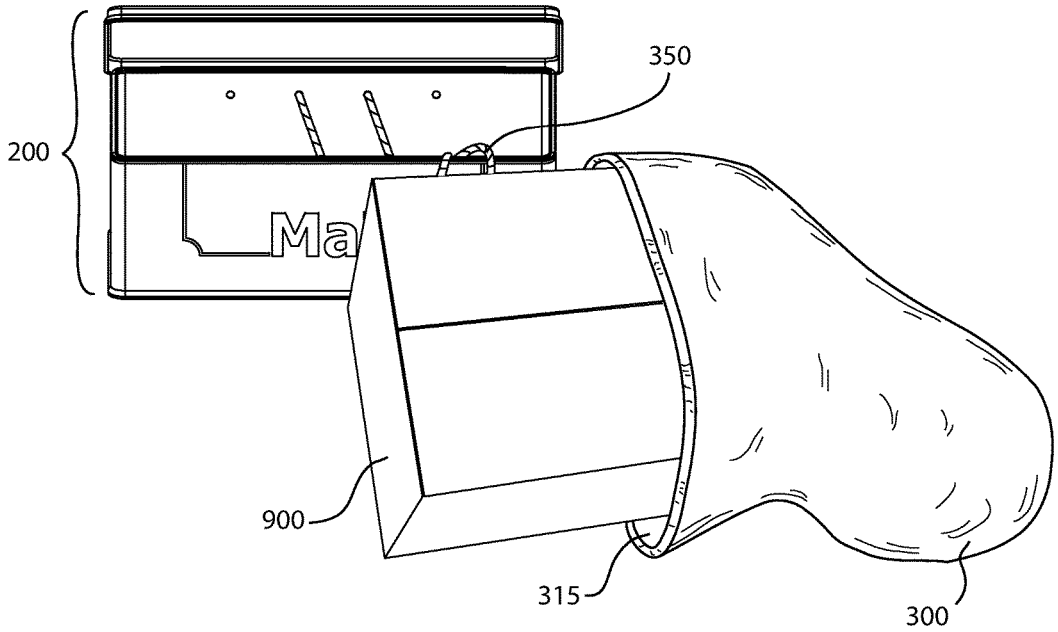
FIG. 7 is an in-use view of an embodiment of the disclosure illustrating a package being placed into the bag.
Figure 8:
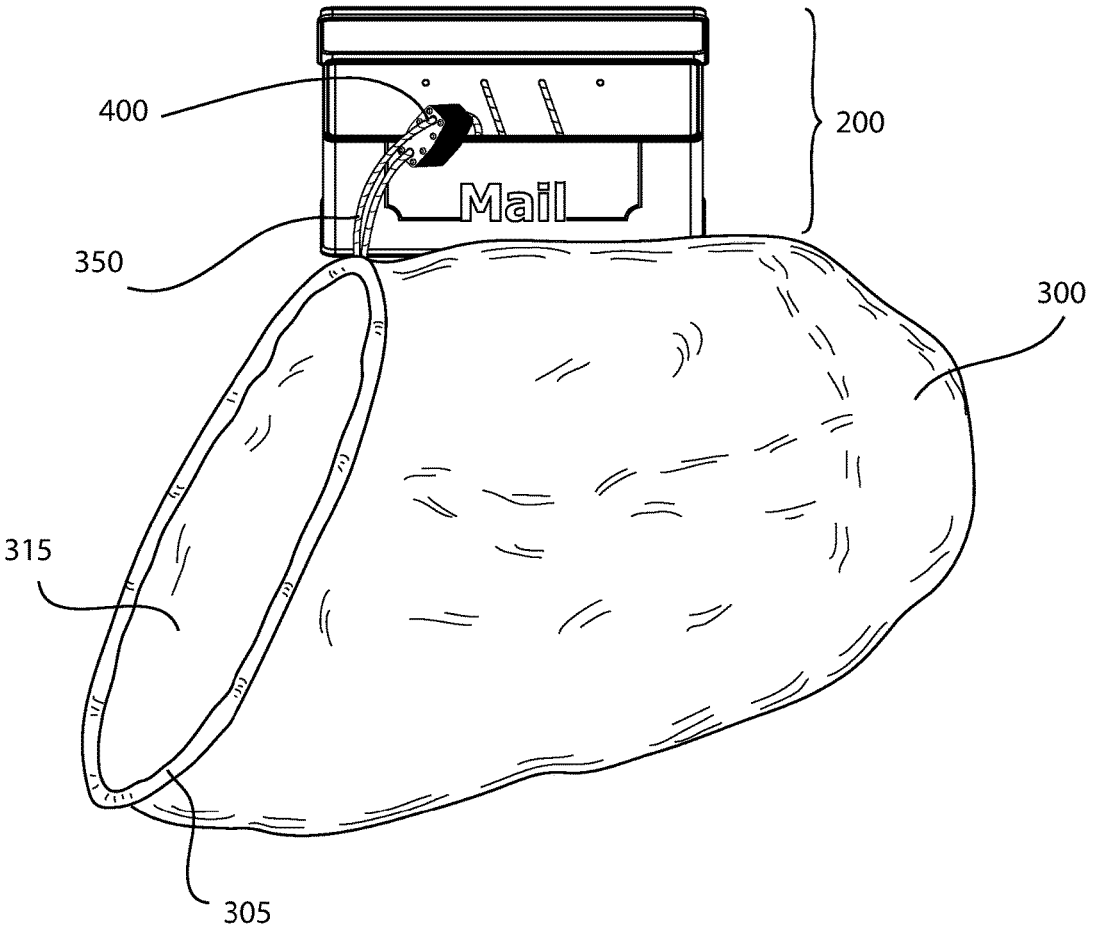
FIG. 8 is an in-use view of an embodiment of the disclosure illustrating a package inside of the bag an the locked being slid towards the bag.
Figure 9:
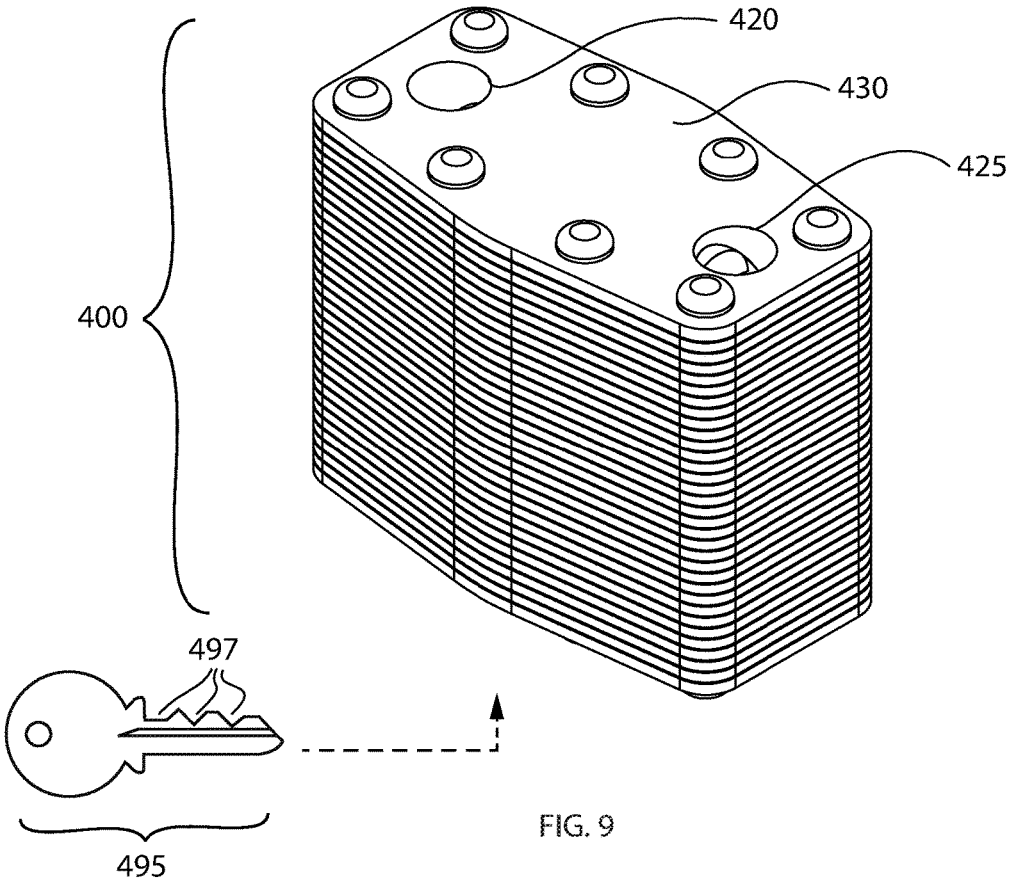
FIG. 9 is a perspective view of an embodiment of the disclosure illustrating the lock with a key.
Figure 11:
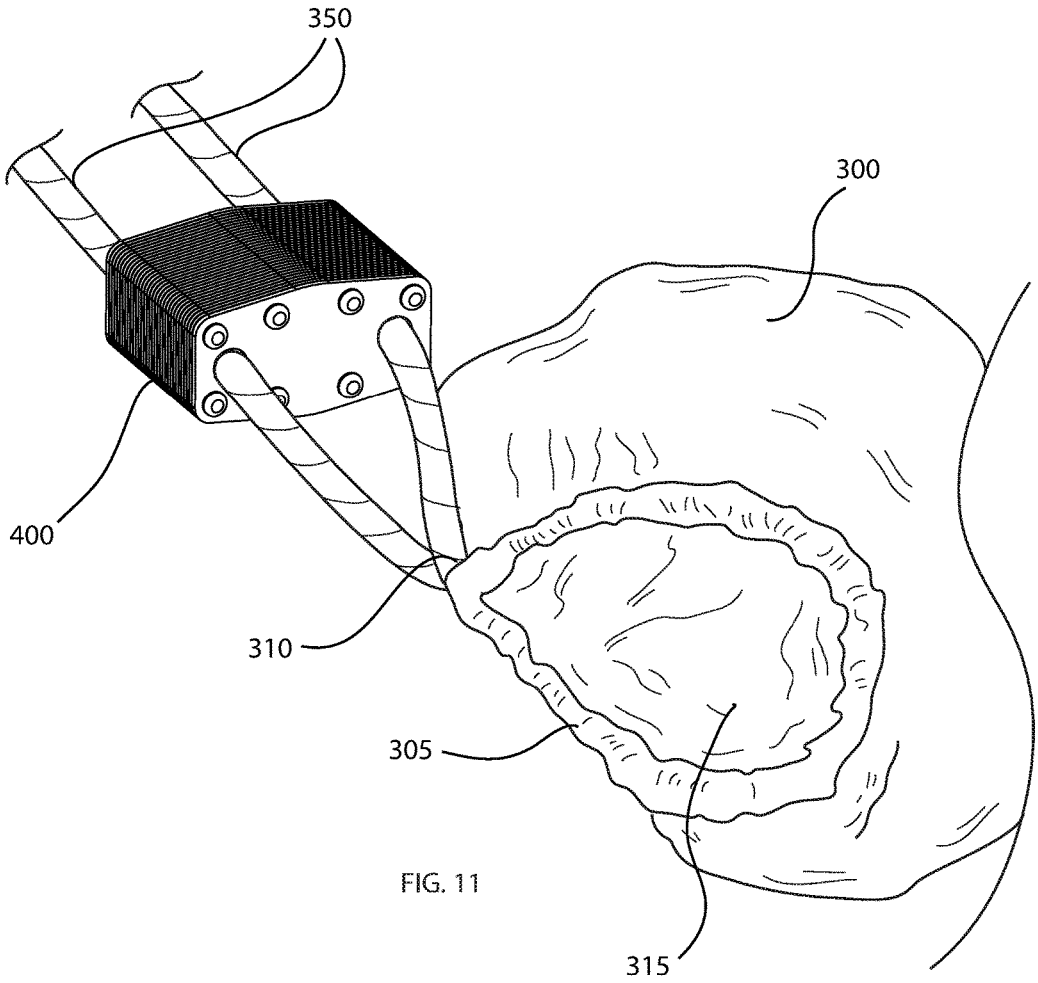
FIG. 11 is a detail view of an embodiment of the disclosure illustrating the lock in position to prevent removal of the package.

Detailed reference will now be made to a first potential embodiment of the disclosure, which is illustrated in FIGS. 1 through 11.

The package locking system 100 (hereinafter invention) comprises a box 200, a bag 300, a cable 350, and a lock 400. The box 200 may mount to a building 910 and be used for receiving mail. The box 200 may also house the bag 300, the cable 350, and the lock 400 that may be used to secure one or more packages 900.

The box 200 comprises a front side wall 205, a rear side wall 210, a left side wall 215, a right side wall 220, a bottom 225, and a lid 230. The front side wall 205 may be a vertical wall of the box 200. The bottom edge of the front side wall 205 may be coupled to front edge of the bottom 225. The left edge of the front side wall 205 may be coupled to front edge of the left side wall 215. The right edge of the front side wall 205 may be coupled to front edge of the right side wall 220.

The left side wall 215 may be a vertical wall of the box 200. The bottom edge of the left side wall 215 may be coupled to left edge of the bottom 225. The front edge of the left side wall 215 may be coupled to left edge of the front side wall 205. The rear edge of the left side wall 215 may be coupled to left edge of the rear side wall 210.

The right side wall 220 may be a vertical wall of the box 200. The bottom edge of the right side wall 220 may be coupled to right edge of the bottom 225. The rear edge of the right side wall 220 may be coupled to right edge of the rear side wall 210. The front edge of the right side wall 220 may be coupled to right edge of the front side wall 205.

The rear side wall 210 may be a vertical wall of the box 200. The bottom edge of the rear side wall 210 may be coupled to rear edge of the bottom 225. The right edge of the rear side wall 210 may be coupled to rear edge of the right side wall 220. The left edge of the rear side wall 210 may be coupled to rear edge of the left side wall 215.

The box 200 may comprise one or more mounting holes 240 for attaching the box 200 to the building 910. In some embodiments, the one or more mounting holes 240 may be located on the rear side wall 210.

The lid 230 may cover the top of the box 200. The rear edge of the lid 230 may be hingedly coupled to the top edge of the rear side wall 210 via a hinge 235.

In some embodiments, the lid 230 may comprise a lip 290 that surrounds the lid 230 and extends downward over the front side wall 205, the rear side wall 210, the left side wall 215, the right side wall 220 or combinations thereof to prevent rain water from entering the box 200.

The interior of the box 200 may comprise one or more cable mounts. The one or more cable mounts may couple the cable 350 to the box 200. In some embodiments, the one or more cable mounts may comprise one or more cable box apertures 250 and a cable clamp (not illustrated in the figures). Ends of the cable 355 may pass through the one or more cable box apertures 250 and may be clamped to each other behind the box 200 via the cable clamp.

The bag 300 may be a container composed of a flexible material. The bag 300 may have a package aperture 315 through which the one or more packages 900 may be placed into and removed from the bag 300.

The bag 300 may comprise a casing 305. The casing 305 may be a hem that surrounds the package aperture 315 and through which the cable 350 may pass. The cable 350 may enter and exit the casing 305 at one or more cable apertures 310. The size of the package aperture 315 may be reduced by pulling the cable 350 to withdraw a portion of the cable 350 from the casing 305. As the cable 350 is withdrawn, the casing 305 may gather, thus reducing the size of the package aperture 315.

The cable 350 may be a wire rope that retains the bag 300 to the box 200. The cable 350 may be nylon coated. The cable 350 may form a loop that passes through the lock 400 twice and that passes through the bag 300.

The lock 400 comprises a body 430, a first lock aperture 420, a second lock aperture 425, an internal mechanism 440, and a key hole 435.

The body 430 may be a metal enclosure for the internal mechanism 440 of the lock 400. As non-limiting examples, the body 430 may be composed of stainless steel or brass.

The first lock aperture 420 and the second lock aperture 425 may each pass through the lock 400 from one surface of the lock 400 to the opposing surface of the lock 400. The lock 400 may be placed into an unlocked state or into a locked state by placing a key 495 into the key hole 435 and turning the key 495. In the unlocked state, the lock 400 may permit itself to be moved freely along the cable 350 in either direction. In the locked state, the lock 400 may prevent itself from sliding along the cable 350 in a direction that is towards the box 200.

The internal mechanism 440 may comprise a plug 445, a keyway 450, a plurality of pins 455, a cam 460, and one or more locking bars 465. The plug 445 may be a cylinder within the body 430 that may be free to rotate within the body 430 and may be prevented from falling out of the body 430. The keyway 450 may be a slot protruding into the center of the plug 445 which accepts the key 495. Turning the key 495 while the key 495 is inserted into the keyway 450 may cause the plug 445 to rotate. The plurality of pins 455 may be spring-loaded shafts that protrude from the side of the body 430 into the plug 445.

The plurality of pins 455 may press against cuts 497 in the key 495 when the key 495 is inserted into the keyway 450 and, based upon the height of the cuts 497, the plurality of pins 455 may be pressed into the body 430 of the lock 400 by varying distances. The plurality of pins 455 may permit rotation of the plug 445 if they all align at a shear line 470 and may prevent rotation of the plug 445 if even one of the plurality of pins 455 does not align at the shear line 470. The shear line 470 may be the boundary between the plug 445 and the body 430. The plurality of pins 455 may vary in length and the length of the plurality of pins 455 may be selected to match a specific one of the keys 495, or vice versa.

In some embodiments, each of the plurality of pins 455 may comprise a top pin (not illustrated in the figures) and a bottom pin (not illustrated in the figures). The top pin may reside within the body 430 and the bottom pin may reside within the plug 445. The top pin and the bottom pin may be pushed towards each other by springs in the body 430 and by the cuts 497 on the key 495. The plug 445 may rotate only when the boundary between the top pin and the bottom pin aligns at the shear line 470 between the plug 445 and the body 430. The key 495 that is inserted must have a specific pattern of the cuts 497 in order to align all of the plurality of pins 455 at the shear line 470 and allow the plug 445 to be turned.

The cam 460 may be a bar-shaped protrusion at the longitudinal end of the plug 445 that is inside of the body 430. The cam 460 may push the one or more locking bars 465 away from the center of the lock 400 when the plug 445 is turned to place the lock 400 in the locked state and may allow the one or more locking bars 465 to retract towards the center of the lock 400 when the plug 445 is turned to place the lock 400 in the unlocked state.

The one or more locking bars 465 may be one or more armatures that move laterally within the lock 400 to prevent or allow movement of the cable 350 through the first lock aperture 420 and the second lock aperture 425. Specifically, when the one or more locking bars 465 are extended, away from the center of the lock 400, they may create friction with the cable 350 and prevent movement of the cable 350. When the one or more locking bars 465 are retracted, towards the center of the lock 400, they may clear the cable 350 and the cable 350 may move. The one or more locking bars 465 may be moved towards their retracted positions by one or more locking bar springs 480 and may be moved towards their extended positions by pressure from the cam 460.

In some embodiments, the one or more locking bars 465 may permit movement of the lock 400 in a direction towards the bag 300 when in the locked state. This may permit the one or more packages 900 to be placed into the bag 300 and the bag 300 to be secured by someone who does not have access to the key 495. As non-limiting examples, the ends of the one or more locking bars 465 that contact the cable 350 may comprise inclined teeth, barbed teeth, or hinged teeth (not illustrated in the figures) that bite into the nylon covering of the cable 350 when an attempt is made to move the lock 400 away from the bag 300 but which gradually compress the nylon covering and allow the cable 350 to slide past the one or more locking bars 465 when an attempt is made to slide the lock 400 towards the bag 300.

In some embodiments, the box 200 may comprise weather-resistant materials and/or weather-resistant finishes. As a non-limiting example, the box 200 may be composed of galvanized steel with a powder-coated finish.

In some embodiments, the bag 300 may comprise, in whole or in part, aramid or para-aramid fibers to increase durability of the bag 300 and/or to increase resistance to damage from cutting.

In use, the invention 100 may be mounted to the building 910 using the one or more mounting holes 240. The lock 400, the cable 350, and the bag 300 may be placed inside of the box 200 and the lid 230 of the box 200 is closed. The mail may be delivered by opening the lid 230, placing the mail inside of the box 200, and closing the lid 230. To deliver the one or more packages 900, first the lid 230 of the box 200 may be opened. Then the bag 300, the lock 400 and the cable 350 may be pulled out of the box 200. Next, the one or more packages 900 may be placed into the bag 300 through the package aperture 315. The lock 400 may be slid towards the bag 300, reducing the size of the package aperture 315 to the point where the one or more packages 900 may no longer be removed from the bag 300. The lid 230 of the box 200 may be closed. To retrieve the one or more packages 900, the key 495 may be used to release the lock 400 and slide it back towards the box 200, allowing the package aperture 315 to enlarge.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "align" refers to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" is an opening in a surface. Aperture may be synonymous with hole, slit, crack, gap, slot, or opening.

As used in this disclosure, a "bag" is a container made of a flexible material. The bag has a single opening, which allows the bag to receive the items to be contained.

As used herein, "casing" refers to material at the edge of a fabric, which has been folded and bonded to form a hollow channel. The casing may be used to hold and/or pass elastic, cording, or boning.

In this disclosure, "compress" refers to forcing into a smaller space.

As used herein, the words "couple", "couples", "coupled" or "coupling", refer to connecting, either directly or indirectly, and does not necessarily imply a mechanical connection.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder, which is defined as a cylinder wherein the curved surface perpendicularly intersects with the two identical flat and parallel ends.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "hinge" is a device that permits the turning, rotating, or pivoting of a first object relative to a second object.

As used in this disclosure, the word "interior" is used as a relational term that implies that an object is located or contained within the boundary of a structure or a space.

As used in this disclosure, the word "lateral" refers to the sides of an object or movement towards a side. Lateral directions are generally perpendicular to longitudinal directions. "Laterally" refers to movement in a lateral direction.

As used in this disclosure, a "lid" is a movable or removable cover that is placed on a hollow structure to contain and/or protect the contents within the hollow structure.

As used in this disclosure, a "lock" is a fastening device that is released through the use of a key, a numeric or alphanumeric combination, or a biometric identification protocol.

As used herein, the word "longitudinal" or "longitudinally" refers to a lengthwise or longest direction.

As used herein, a "longitudinal edge" or "longitudinal end" is an edge or end that is reached when traversing an object in a longitudinal direction.

As used in this disclosure, a "slot" is a long narrow groove, cut, opening, or aperture that is formed in or through an object.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 11, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A package locking system comprising:

a box, a bag, a cable, and a lock;

wherein the box mounts to a building and be used for receiving mail;

wherein the box houses the bag, the cable, and the lock;

wherein the box comprises a front side wall, a rear side wall, a left side wall, a right side wall, a bottom, and a lid;

wherein the front side wall is a vertical wall of the box;

wherein the bottom edge of the front side wall is coupled to front edge of the bottom;

wherein the left edge of the front side wall is coupled to front edge of the left side wall;

wherein the right edge of the front side wall is coupled to front edge of the right side wall;

wherein the left side wall is a vertical wall of the box;

wherein the bottom edge of the left side wall is coupled to left edge of the bottom;

wherein the front edge of the left side wall is coupled to left edge of the front side wall;

wherein the rear edge of the left side wall is coupled to left edge of the rear side wall;

wherein the right side wall is a vertical wall of the box;

wherein the bottom edge of the right side wall is coupled to right edge of the bottom;

wherein the rear edge of the right side wall is coupled to right edge of the rear side wall;

wherein the front edge of the right side wall is coupled to right edge of the front side wall;

wherein the rear side wall is a vertical wall of the box;

wherein the bottom edge of the rear side wall is coupled to rear edge of the bottom;

wherein the right edge of the rear side wall is coupled to rear edge of the right side wall;

wherein the left edge of the rear side wall is coupled to rear edge of the left side wall;

wherein the box comprises one or more mounting holes for attaching the box to the building;

wherein the one or more mounting holes are located on the rear side wall;

wherein the lid covers the top of the box;

wherein the rear edge of the lid is hingedly coupled to the top edge of the rear side wall via a hinge;

wherein the lid comprises a lip that surrounds the lid and extends downward over the front side wall, the rear side wall, the left side wall, the right side wall or combinations thereof to prevent rain water from entering the box;

wherein the interior of the box comprises one or more cable mounts;

wherein the one or more cable mounts couple the cable to the box;

wherein the one or more cable mounts comprise one or more cable box apertures and a cable clamp;

wherein ends of the cable pass through the one or more cable box apertures and are clamped to each other behind the box via the cable clamp.

2. The package locking system according to claim 1 wherein the bag is a container composed of a flexible material;

wherein the bag has a package aperture through which the one or more packages are placed into and removed from the bag.

3. The package locking system according to claim 2 wherein the bag comprises a casing;

wherein the casing is a hem that surrounds the package aperture and through which the cable passes;

wherein the cable enters and exits the casing at one or more cable apertures;

wherein the size of the package aperture is reduced by pulling the cable to withdraw a portion of the cable from the casing;

wherein as the cable is withdrawn, the casing gathers, thus reducing the size of the package aperture.

4. The package locking system according to claim 3 wherein the cable is a wire rope that retains the bag to the box;

wherein the cable is nylon coated;

wherein the cable forms a loop that passes through the lock twice and that passes through the bag.

5. The package locking system according to claim 4 wherein the lock comprises a body, a first lock aperture, a second lock aperture, an internal mechanism, and a key hole;

wherein the body is a metal enclosure for the internal mechanism of the lock.

6. The package locking system according to claim 5 wherein the first lock aperture and the second lock aperture each pass through the lock from one surface of the lock to the opposing surface of the lock;

wherein the lock is placed into an unlocked state or into a locked state by placing a key into the key hole and turning the key;

wherein in the unlocked state, the lock permits itself to be moved freely along the cable in either direction;

wherein in the locked state, the lock prevents itself from sliding along the cable in a direction that is towards the box.

7. The package locking system according to claim 6 wherein the internal mechanism comprises a plug, a keyway, a plurality of pins, a cam, and one or more locking bars;

wherein the plug is a cylinder within the body that is free to rotate within the body and is prevented from falling out of the body;

wherein the keyway is a slot protruding into the center of the plug which accepts the key;

wherein turning the key while the key is inserted into the keyway causes the plug to rotate;

wherein the plurality of pins are spring-loaded shafts that protrude from the side of the body into the plug.

8. The package locking system according to claim 7
wherein the plurality of pins press against cuts in the key when the key is inserted into the keyway and, based upon the height of the cuts, the plurality of pins are pressed into the body of the lock by varying distances;
wherein the plurality of pins permit rotation of the plug if they all align at a shear line and prevent rotation of the plug if even one of the plurality of pins does not align at the shear line;
wherein the shear line is the boundary between the plug and the body;
wherein the plurality of pins vary in length and the length of the plurality of pins is selected to match a specific one of the keys, or vice versa.

9. The package locking system according to claim 8
wherein each of the plurality of pins comprise a top pin and a bottom pin;
wherein the top pin resides within the body and the bottom pin resides within the plug;
wherein the top pin and the bottom pin are pushed towards each other by springs in the body and by the cuts on the key;
wherein the plug rotates only when the boundary between the top pin and the bottom pin aligns at the shear line between the plug and the body;
wherein the key that is inserted must have a specific pattern of the cuts in order to align all of the plurality of pins at the shear line and allow the plug to be turned.

10. The package locking system according to claim 8
wherein the cam is a bar-shaped protrusion at the longitudinal end of the plug that is inside of the body;
wherein the cam pushes the one or more locking bars away from the center of the lock when the plug is turned to place the lock in the locked state and allows the one or more locking bars to retract towards the center of the lock when the plug is turned to place the lock in the unlocked state.

11. The package locking system according to claim 10
wherein the one or more locking bars are one or more armatures that move laterally within the lock to prevent or allow movement of the cable through the first lock aperture and the second lock aperture;
wherein when the one or more locking bars are extended, away from the center of the lock, they create friction with the cable and prevent movement of the cable;
wherein when the one or more locking bars are retracted, towards the center of the lock, they clear the cable and the cable moves;
wherein the one or more locking bars are moved towards their retracted positions by one or more locking bar springs and are moved towards their extended positions by pressure from the cam.

12. The package locking system according to claim 11
wherein the one or more locking bars permit movement of the lock in a direction towards the bag when in the locked state.

13. The package locking system according to claim 12
wherein the bag comprises, in whole or in part, aramid or para-aramid fibers to increase durability of the bag and/or to increase resistance to damage from cutting.

* * * * *